US006017197A

United States Patent [19]

Jensen et al.

[11] Patent Number: 6,017,197

[45] Date of Patent: Jan. 25, 2000

[54] SUCTION SOUND DAMPER FOR A REFRIGERANT COMPRESSOR

[75] Inventors: Michael Skovgaard Jensen, Silkeborg; Frank Holm Iversen, Padborg, both of Denmark

[73] Assignee: Danfoss Compressors GmbH, Flensburg, Germany

[21] Appl. No.: 08/981,277

[22] PCT Filed: Jun. 21, 1996

[86] PCT No.: PCT/DK96/00272

§ 371 Date: Dec. 23, 1997

§ 102(e) Date: Dec. 23, 1997

[87] PCT Pub. No.: WO97/01036

PCT Pub. Date: Jan. 9, 1997

[30] Foreign Application Priority Data

Jun. 23, 1995 [DE] Germany ..... 195 22 383

[51] Int. Cl.[7] ..... F04B 53/00

[52] U.S. Cl. ..... 417/312; 181/249

[58] Field of Search ..... 417/312; 181/403, 181/272, 249, 250

[56] References Cited

U.S. PATENT DOCUMENTS

| | | | |
|---|---|---|---|
| 4,109,751 | 8/1978 | Kabele | 181/247 |
| 4,313,715 | 2/1982 | Richardson, Jr. | 417/312 |
| 4,370,104 | 1/1983 | Nelson et al. | 417/312 |
| 4,755,108 | 7/1988 | Todescat et al. | 417/312 |
| 4,960,368 | 10/1990 | Lilie | 417/312 |
| 5,201,640 | 4/1993 | Heinzelmann et al. | 417/312 |

*Primary Examiner*—Charles G. Freay
*Assistant Examiner*—Robert Z. Evora
*Attorney, Agent, or Firm*—Lee, Mann, Smith, McWilliam, Sweeney & Ohlson

[57] ABSTRACT

A suction sound damper for a refrigerant compressor is disclosed, having an inlet, which is arranged to be connected to a suction port, and an outlet, which is arranged to be connected to the refrigerant compressor, and also having at least one damping volume. It is desirable for a suction sound damper of that kind to be of simple and inexpensive construction, and to contribute to increasing the efficiency of a refrigerant compressor. For that purpose, it is formed from a first and second half which define an internal space in which the damping volume is arranged, the first half having projecting into the internal space a gas deflection wall which, at least over sections thereof, forms a lateral limitation of a flow path free from throttle points between inlet and outlet.

20 Claims, 1 Drawing Sheet

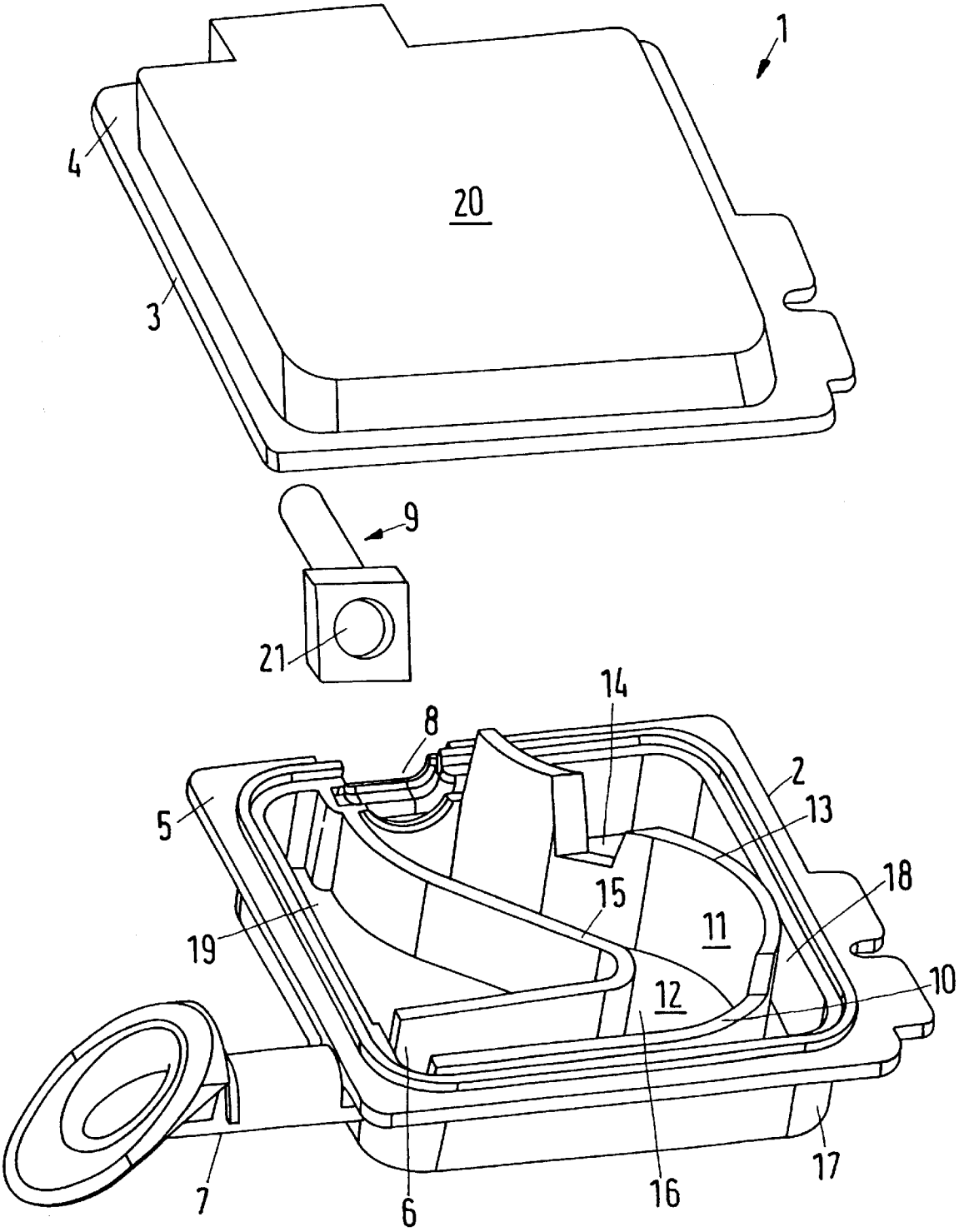
1
4
20
3
9
21
14
8
2
5
13
18
15
11
19
10
12
7
6
16
17

SUCTION SOUND DAMPER FOR A REFRIGERANT COMPRESSOR

BACKGROUND OF THE INVENTION

The invention relates to a suction sound damper for a refrigerant compressor, having an inlet, which is arranged to be connected to a suction port, and an outlet, which is arranged to be connected to the refrigerant compressor, and also having at least one damping volume.

Such a suction sound damper is known from U.S. Pat. No. 5,201,640. In this suction sound damper, the inlet is connected to the outlet by way of a tube. The tube forces a number of direction changes on the gaseous refrigerant flowing through it. The tube has a number of radial openings through which the inside of the tube is in connection with the damping volume which surrounds the tube. The known solution is firstly relatively expensive, because the tube is constructed as a separate component which accordingly requires a further manufacturing step and additional material. Moreover, the many directional changes in the flow of refrigerant lead to an increased flow resistance, with the result that the efficiency of a compressor which is provided with such a suction sound damper may suffer.

Another suction sound damper is known from DE 36 45 083 C2. This suction sound damper consists of two halves that are joined together and then enclose four chambers which are connected to one another partly by throttling points and partly by a throttling channel. These throttling points and channels also lead to a relatively large flow resistance, with adverse consequences for the efficiency of a compressor equipped therewith. Such a suction sound damper can, however, be manufactured relatively inexpensively.

SUMMARY OF THE INVENTION

The invention is based on the problem of providing a simple and inexpensive suction sound damper for a refrigerant compressor, which allows improved efficiency of the refrigerant compressor.

That problem is solved in a suction sound damper of the kind mentioned in the introduction in that it is formed from a first and a second half which define an internal space in which the damping volume is arranged, the first half having projecting into the internal space a gas deflection wall which, at least over sections thereof, forms a lateral limitation of a flow path free from throttle points between inlet and outlet.

With such a construction the flow resistance of the suction sound damper can be reduced quite considerably. The efficiency of the compressor which is provided with such a suction sound damper can therefore be increased. Surprisingly, there is a satisfactory sound damping even without relatively large throttling resistances. On the contrary, it is now possible for the refrigerant flowing through the flow path to expand into the damping volume arranged likewise in the internal space. The function of the gas deflection wall is substantially merely to guide the gaseous refrigerant, which flows through the suction sound damper, at least over sections thereof from the inlet to the outlet. The gas deflection wall itself no longer forms any throttling points. Because the flow losses are kept small, the refrigerant can flow through the suction sound damper at a uniform speed, but with a lower pressure drop. Because the suction sound damper is arranged, in the case of encapsulated domestic refrigeration machines, generally within the capsule, that is, within an atmosphere of refrigerant that has already been heated, the flow speed that can be achieved has the advantage that the refrigerant that is still cold in the suction sound damper does not become appreciably warm. Any such warming leads to loss of density and thus to impairment of the efficiency of the refrigerant compressor.

The inlet preferably opens substantially parallel to the gas deflection wall into the internal space. The gas deflection wall is thus located approximately tangentially to the incoming refrigerant. Eddying of the refrigerant, which could lead to an increase in the flow resistance and to slowing of the refrigerant, are therefore largely avoided.

It is also preferred for the outlet to run substantially parallel to the gas deflection wall. Eddying is also avoided by this measure. Flow resistances which could occur at the transition between the flow path and the outlet are thus kept as small as possible.

The gas deflection wall preferably has a curve effecting a directional change between inlet and outlet. This has the advantage, firstly, that such a suction sound damper can be used also with known refrigerant compressors, in which inlet and outlet of the suction sound damper are not in alignment but are offset by, for example, 90° with respect to one another. The curve of the gas deflection wall also has the advantage, however, that the incoming refrigerant is pressed against the gas deflection wall, whereby reliable guidance of the refrigerant along the flow path is ensured. The curve should in that case be as "round" or "gentle" as possible in order to effect a gradual directional change in the refrigerant flow. The larger is the radius of curvature of the curve, the smaller are the flow losses. The radius of curvature is limited, of course, by the overall size of the suction sound damper.

The gas deflection wall is preferably of increased height in the region of the curve. By this means the refrigerant flowing is prevented from being displaced or "sloshed" over the gas deflection wall because of centrifugal force, so that it is kept, mainly at least, on the flow path.

In an especially preferred construction, a boundary wall is provided substantially parallel to the gas deflection wall on the opposite side of inlet and outlet. Inlet and outlet thus open out between the gas deflection wall and the boundary wall. In this manner, slowly rotating turbulence is prevented from forming on the side of the flow path remote from the gas deflection wall; such turbulence leads to transfer of heat from the outside of the sound damper to the suction line, thus allowing the refrigerant inside the suction sound damper to become warm when it stays there for a relatively long time. As stated above, such warming would contribute to impairment of the efficiency of the refrigerant compressor. Projections in the first and second half can form a labyrinth in the damping volume. In that case, transfer of heat from the outside of the sound damper to the suction channel is reduced.

The boundary wall also is preferably provided on the first half. This simplifies manufacture.

In an especially preferred construction, the gas deflection wall runs, at least for the majority of its length, spaced apart from an outer wall of the first half. Between the outer wall and the gas deflection wall quiescent gas volumes are able to form, which contribute to thermal insulation between the outer wall and the gas deflection wall. Introduction of heat into the flow channel from this outer wall is therefore very reliably prevented. Warming of the refrigerant flowing through the suction sound damper is thus also reduced.

The gas deflection wall and/or the boundary wall preferably have a predetermined spacing from the top wall of the second half. The flow path for the refrigerant is therefore combined for virtually the entire cross-section of the flow channel with a relatively large damping volume inside the suction sound damper. Pressure pulses that occur as a consequence of the back and forth movement of the piston of the refrigerant compressor and therefore in combination with the pulsed suction of the refrigerant, can then spread out in the damping volume, without having to overcome relatively large throttling resistances. This produces a very effective sound damping.

In an especially preferred construction, provision is made for the inlet to open into the internal space close to the base of the first half. In that case, the refrigerant is able to bend round at a relatively low pressure level along the base of the first half against this base and clings, as it were, to the base of the first half. This effect arises because the incoming refrigerant gas entrains the stationary gas in the region of the flow path with it and a reduced pressure consequently occurs along the wall; the main gas flow delivers the region of reduced pressure towards the wall.

The outlet is preferably provided with an outlet connector which is fixed between the first and the second half, an opening of the outlet connector being located in the internal space. An inflow into the outlet connector is thereby effected directly from the flow path and not from the surrounding damping volume. The effective opening cross-section is enlarged here. The damping volume is therefore able to fill with quiescent refrigerant in which only a few movements occur. Intermingling of warm and cold refrigerant takes place only to a very slight extent.

BRIEF DESCRIPTION OF THE DRAWING

The invention is described hereinafter with reference to a preferred embodiment in conjunction with the drawings, in which:

FIG. 1 is a perspective exploded view of a suction sound damper.

DESCRIPTION OF THE PREFERRED EMBODIMENT

A suction sound damper 1 comprises a first half 2 and a second half 3 which together define an internal space when they are joined to one another by their flanges 4, 5.

The suction sound damper 1 has an inlet 6, which can be connected by way of an inlet connector 7 to a suction port of a housing, not illustrated. Refrigerant is sucked in through this suction port.

The suction sound damper further has an outlet 8 in which an outlet connector 9 can be inserted. The outlet connector 9 can be connected to a refrigerant compressor, likewise not illustrated.

In the first half 2 there is arranged a gas deflection wall 10 which runs from inlet 6 to outlet 8 and extends in the internal space between the two halves 2, 3. The gas deflection wall 10 here forms a curve 11 with as large a radius of curvature as possible.

In the region of the inlet 6 the gas deflection wall 10 is aligned substantially parallel to the inlet 6. Inflowing refrigerant therefore flows substantially tangentially to the gas deflection wall 10. The same applies to the region of the outlet 8, where the gas deflection wall 10 is arranged substantially parallel to the outlet 8.

The inlet connector 7 has its opening close to the base 12 of the first half 2. In that case, the so-called "Coanda effect" causes the gaseous refrigerant to attach itself to the base 12 of the first half 2. A flow path for the refrigerant therefore develops along the gas deflection wall 10. The refrigerant, as stated, is held against the base by the Coanda effect, and is held against the gas deflection wall by the centrifugal force which presses the gaseous refrigerant against the gas deflection wall 10 on a change in direction.

In the region of the curve 11, the gas deflection wall 10 has an increased height 13. This increased height 13 can extend approximately as far as the outlet 8; the increased height 13 may be interrupted by a gap 14. The gap 14 is in that case preferably arranged where there is no concave curvature of the gas deflection wall 10 and, if possible, where there is a convex curvature.

Substantially parallel to the gas deflection wall 10 there is arranged a boundary wall 15. The boundary wall 15 prevents slowly rotating turbulence from forming on the side of the flow path opposite to the gas deflection wall 10; although this turbulence does not lead to an appreciable increase in the flow resistance through the suction sound damper, it could lead to warming of the gaseous refrigerant staying in the suction sound damper. A region between the gas deflection wall 10 and the boundary wall 15 can now be defined as the flow path 16 or gas conduction path. Note, however, that this flow path 16 would develop in virtually the same manner if the boundary wall 15 were not present.

The gas deflection wall 10 runs, at least for the majority of its length, always spaced apart from an outer wall 17 of the first half. Dead spaces 18 which fill with gaseous refrigerant are therefore created. The same applies to the boundary wall 15, which likewise runs spaced apart from the outer wall 17 of the first half and encloses with this outer wall 17 a dead space 19.

The gas deflection wall 10 and the boundary wall 15 terminate at a predetermined spacing from a top wall 20 of the second half 3. Virtually the entire space between the top wall 20 and the upper side of the gas deflection wall 10 where the height is not increased and the upper side of the boundary wall 15 is therefore available as damping volume. This is supplemented by the dead spaces 18, 19. In the region of the gas deflection wall 10 there is also a connection between the flow path 16 and the damping volume, for example, by way of the gap 14 or the region in front of the raised wall 13 of the curve 11. The upper side of the gas deflection wall 10 here follows the top wall 20 with a constant gap. In this manner a very good connection between the flow path and the damping volume is created. Short pressure surges, which are caused by the pulsed feeding of the refrigerant, are then able to expand in this damping volume; the expansion does not encounter any appreciable flow resistance. On the other hand, movement of gas in the damping volume is only very limited, so that there is virtually no, or only negligible, exchange of the refrigerant gas from the flow path 16 with gas from the damping volume.

The outlet connector 9 is simply inserted between the first and the second halves 2, 3. It can be made of a material having a different thermal conductivity from the material of the two halves 2, 3.

The outlet connector 9 has an inlet opening 21 which is located in the internal space enclosed by the two halves 2, 3, to be precise, in the region of the flow path 16. Inflow into the outlet connector 9 is therefore effected only from the region of the gas deflection wall 10, and not from the surrounding damping volume. Because there is virtually no radial flow into the connector from the damping volume, a greater effective cross-section is achieved in the outlet connector 9.

Whereas in the region of the boundary wall 15 there is a gap between the top wall 20 and the boundary wall 15 for the entire length of the boundary wall 15, the gas deflection wall 10 may possibly, in the region where its height is increased, abut the top wall 20. This greater height 13 not only prevents gas being displaced over the gas deflection wall; it may also intercept oil droplets entrained with the refrigerant and also drops of refrigerant that has already condensed. These drops can then run down the gas deflection wall 10 and, if it is so desired, drain off through the inlet 6 when the compressor next stops. This is easily possible because the inlet, as stated above, is arranged close to the base 12. Ingress of drops of fluid into the compressor is largely avoided.

By means of the suction sound damper 1, not only is a reduction in the flow resistance achieved, with the result that the compressor requires less effort to draw in the refrigerant; the refrigerant is also able to flow more quickly through the suction sound damper 1, with the result that the risk that the refrigerant will become warm is reduced. Efficiency is also improved as a result of this measure.

Both halves 2, 3 can be manufactured from plastics material as injection-moulded parts. With such a construction both the gas deflection wall 10 and the boundary wall 15 can be integrally moulded directly with the first half 2, without further measures being necessary. The profiled connections between the two halves 2, 3, which later result in an improved sealing of the suction sound damper, can be similarly moulded.

We claim:

1. Suction sound damper for a refrigerant compressor, the sound damper having an inlet which is arranged to be connected to a suction port and an outlet which is arranged to be connected to the refrigerant compressor, and also having at least one damping volume, the sound damper being formed from a first and a second half which define an internal space in which the damping volume is arranged, the first half having a gas deflection wall projecting from the first half into the internal space which, at least over sections of the gas deflection wall, forms a lateral limitation of a flow path free from throttle points between the inlet and the outlet.

2. Suction sound damper according to claim 1, in which the inlet opens substantially parallel to the gas deflection wall in the internal space.

3. Suction sound damper according to claim 1, in which the outlet extends substantially parallel to the gas deflection wall.

4. Suction sound damper according to claim 1, in which the gas deflection wall has a curve effecting a directional change between the inlet and the outlet.

5. Suction sound damper according to claim 4, in which the gas deflection wall is of increased height proximate the curve.

6. Suction sound damper according to claim 1, in which a boundary wall is provided substantially parallel to the gas deflection wall and extending from an opposite side of the inlet and the outlet.

7. Suction sound damper according to claim 6, in which the boundary wall is located on the first half.

8. Suction sound damper according to claim 1, in which the boundary wall has a predetermined spacing from a top wall of the second half.

9. Suction sound damper according to claim 1, in which the gas deflection wall extends, at least for a majority of its length, spaced apart from an outer wall of the first half.

10. Suction sound damper according to claim 1, in which the gas deflection wall has a predetermined spacing from a top wall of the second half.

11. Suction sound damper according to claim 1, in which the inlet opens into the internal space close to a base of the first half.

12. Suction sound damper according to claim 1, in which the outlet includes an outlet connector which is fixed between the first and the second half, an opening of the outlet connector being located in the internal space.

13. Suction sound damper for a refrigerant compressor, the sound damper having an inlet which is arranged to be connected to a suction port and an outlet which is arranged to be connected to the refrigerant compressor, and also having at least one damping volume, the sound damper being formed from a first and a second half which define an internal space in which the damping volume is arranged, the first half having a gas deflection wall projecting into the internal space which, at least over sections of the gas deflection wall, forms a lateral limitation of a flow path free from throttle points between the inlet and the outlet, and which has a predetermined spacing from a top wall of the second half.

14. Suction sound damper according to claim 13, in which the inlet opens substantially parallel to the gas deflection wall in the internal space.

15. Suction sound damper according to claim 14, in which the gas deflection wall is of increased height proximate the curve.

16. Suction sound damper according to claim 13, in which the outlet extends substantially parallel to the gas deflection wall.

17. Suction sound damper according to claim 13, in which the gas deflection wall has a curve effecting a directional change between the inlet and the outlet.

18. Suction sound damper according to claim 13, in which a boundary wall is provided substantially parallel to the gas deflection wall and extending from an opposite side of the inlet and the outlet.

19. Suction sound damper according to claim 18, in which the boundary wall has a predetermined spacing from a top wall of the second half.

20. Suction sound damper according to claim 13, in which the gas deflection wall extends, at least for a majority of its length, spaced apart from an outer wall of the first half.

* * * * *